US006276307B1

(12) United States Patent
Marran

(10) Patent No.: US 6,276,307 B1
(45) Date of Patent: Aug. 21, 2001

(54) HEATING APPARATUS, HOUSING AND STAND

(75) Inventor: Roger D. Marran, Califon, NJ (US)

(73) Assignee: Energy Kinetics, Inc., Lebanon, NJ (US)

( * ) Notice: Subject to any disclaimer, the term of this patent is extended or adjusted under 35 U.S.C. 154(b) by 0 days.

(21) Appl. No.: 09/469,365

(22) Filed: Dec. 22, 1999

(51) Int. Cl.[7] ..... F23M 7/00

(52) U.S. Cl. ..... 122/497; 122/498; 110/172; 110/173 R

(58) Field of Search ..... 122/13.01, 497, 122/498, 499; 432/250; 110/172, 173 R

(56) References Cited

U.S. PATENT DOCUMENTS

| | | | | |
|---|---|---|---|---|
| 563,990 | * | 7/1896 | Tetley | 122/499 |
| 787,617 | | 4/1905 | Evans . | |
| 1,416,487 | | 5/1922 | Mauck . | |
| 2,200,304 | | 5/1940 | Sands . | |
| 2,237,054 | | 4/1941 | Jensen . | |
| 2,562,023 | | 7/1951 | Dufault . | |
| 3,151,615 | | 10/1964 | Siniaho . | |
| 3,934,554 | | 1/1976 | Carlson . | |
| 4,261,299 | | 4/1981 | Marran . | |
| 4,418,649 | | 12/1983 | Purvis . | |
| 4,493,308 | * | 1/1985 | Hurley et al. | 432/209 |
| 4,872,443 | | 10/1989 | Ruark . | |
| 5,803,021 | * | 9/1998 | Rourke et al. | 122/498 |
| 6,085,701 | * | 7/2000 | Stauffer et al. | 122/367.1 |

OTHER PUBLICATIONS

High Operational Reliability and Long Service Life with the Eutectoplex Heat Transfer Surface.
Reduced Emissions due to Triple–Pass Design.

* cited by examiner

*Primary Examiner*—Gregory Wilson
(74) *Attorney, Agent, or Firm*—Dickstein Shapiro Morin & Oshinsky LLP

(57) ABSTRACT

A boiler apparatus is provided with a forwardly-opening hinged door. To open the door, the top of the door is moved away from the housing and toward the technician. One or more hinges may be located at the bottom of the door. Since the door does not open sideways, the apparatus requires reduced side-to-side floor space. The door may be used to obtain access to heat transfer surfaces. The door is preferably constructed to minimize the floor space occupied by and required to service the apparatus. The apparatus may include a stand for supporting the boiler at an elevated location for inspection and maintenance. A water tank may be located underneath the boiler.

20 Claims, 3 Drawing Sheets

HEATING APPARATUS, HOUSING AND STAND

BACKGROUND OF THE INVENTION

1. Field of the Invention

The present invention relates generally to a boiler apparatus or other fluid heating apparatus, and to a housing for containing and supporting a boiler. The present invention also relates to a door for providing access to a boiler located in a confined location. The present invention also relates to a method of operating and/or maintaining a boiler apparatus.

2. Description of the Related Art

Known boilers (fluid heating devices) use various combustion processes which produce flue products consisting of water vapor, carbon dioxide, unburned fuel, oxidized contaminants, carbon and other particulate material which may and do adhere to the heat transfer surfaces. These surfaces are designed to absorb the heat of combustion as much as possible before the heat exits the boiler into the vent system.

Periodic inspection and cleaning of boiler heat exchange surfaces may be required to insure optimum heat transfer performance. Such maintenance may also be needed to insure that flow passages are free and open so as not to restrict the flow of combustion products. Such obstructions could create back pressure at the burner and reduce proper fuel balance resulting in subsequently less clean burning and increased surface contamination and restriction. There is thus a need in the art for a boiler apparatus that provides optimum heat transfer surface contact for efficient transfer as well as access to the heat transfer surfaces to permit inspection and complete and thorough cleaning when required.

A known boiler that provides efficient heat transfer is described in U.S. Pat. No. 4,261,299. The known boiler has an insulated back cover. The cover may be removed to provide access to the interior heat exchange surfaces for maintenance and repair. Obtaining access to the back cover, which is opposite to the front of the boiler (and opposite the burner and controls), requires a clearance space of at least twelve inches (and preferably twenty-four to thirty inches for easier servicing). The known apparatus has significant space requirements.

Other known boilers, which vary significantly in design of combustion, heat transfer and flue passages, have removable cleanout panels on the top, sides, back or front. Recently, it has been proposed to mount the burner on a hinged door which could swing to either the right or the left (horizontally) to allow access to passages without physical removal and setting the cover aside. A disadvantage associated with the proposed arrangement, however, is that when the door swings to the side, the burner and the cover require a relatively large side access area. The need for side access space may preclude use of the door. In certain confined locations, the door may have to be removed from the housing to gain access to the boiler for inspection and cleaning.

Conventional boilers, due to their heavy weight, are normally mounted on or near the floor. This is a disadvantage because it makes it difficult to service them. The repair technician must be seated on the floor or bent over in an awkward position with poor or incomplete visibility of the passages that need to be inspected or cleaned.

Prior art heating devices are shown in U.S. Pat. Nos. 787,617 (Evans); 1,416,487 (Mauck); 2,200,304 (Sands); 2,237,054 (Jensen); 2,562,023 (Dufault); 3,151,615 (Siniaho); 3,934,554 (Carlson); 4,418,649 (Purvis); and 4,872,443 (Ruark).

SUMMARY OF THE INVENTION

The present invention overcomes many of the problems and disadvantages of the prior art. The present invention relates to an apparatus that has a heater (such as a boiler) for heating water and a housing for containing the heater. According to one aspect of the invention, the heater has a front cover and interior heat transfer surfaces. The housing may have a door for providing access to the heat transfer surfaces. In a preferred embodiment of the invention, the front cover of the heater is a door. One or more hinges may be located at the bottom of the door for supporting the door in a substantially horizontal, open position.

According to another aspect of the invention, the heater is a boiler with spiral flow passages, and the passages are covered and sealed by the front cover when the door is in its closed position. In a preferred embodiment of the invention, the inside of the cover may be lined with compressible insulation material.

In a preferred embodiment of the invention, the housing is supported on a rigid stand. The stand mays be used to provide space for a water tank without increasing the overall footprint of the apparatus. The stand may also be used to elevate the boiler to a position where it can be easily inspected and serviced by a technician in a comfortable position.

According to yet another aspect of the invention, the boiler support legs form a stop or the stand may be used as the hinge stop for supporting the door in its open, horizontal position. If desired, rubber bumpers may be provided on the stand to resiliently support the lightweight door in its open position.

According to yet another aspect of the invention, an electrical switch may be activated by the door for automatically disabling the burner when the door is opened.

The present invention also relates to a method of operating and maintaining a boiler apparatus.

An object of the invention is to provide a boiler apparatus that has reduced space requirements. Another object of the invention is to provide an apparatus that enables easy access and visibility to all combustion areas and passages.

According to another aspect of the invention, the boiler may be located on an elevated stand with all water connections and piping on the top or back of the boiler. Once installed, the pipe connections at the back may not need to be serviced. In a preferred embodiment of the invention, all serviceable components are accessible from the front of the apparatus.

An advantage of locating the burner in an elevated position is that the passages to be inspected and cleaned are fully visible from a normal standing position. Another advantage of locating the burner in an elevated position is that the stand can accommodate a domestic hot water tank. This way, the boiler and the hot water tank can be located in the same small footprint.

In an alternative embodiment of the invention, when vertical height is limited, a base of lesser height may be employed. The reduced height base may perform all of the functions of the taller stand discussed above, except that the reduced height base does not provide a location for the hot water tank.

According to another aspect of the invention, a door switch may be located in the electrical box adjacent to the top of the closed door. The switch may be used to disconnect the power supply to the burner upon lowering the door.

BRIEF DESCRIPTION OF THE DRAWINGS

The foregoing and other advantages and features of the invention will become more apparent from the detailed description of preferred embodiments given below with reference to the accompanying drawings, in which.

DETAILED DESCRIPTION OF PREFERRED EMBODIMENTS

Figure 1:
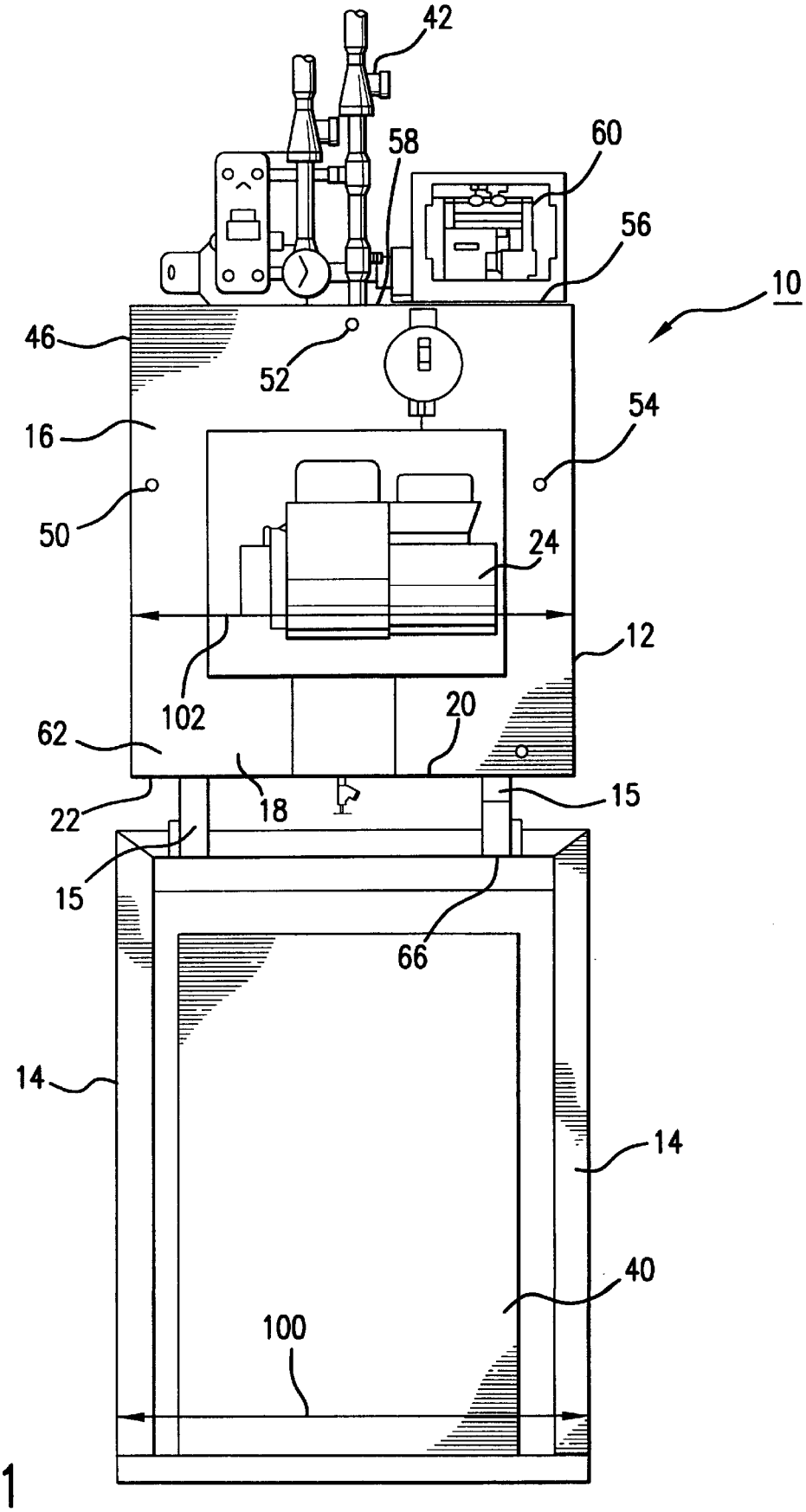
FIG. 1 is a front view of a boiler apparatus constructed in accordance with a preferred embodiment of the present invention.

Referring now to the drawings, where like reference numerals designate like elements, there is shown in FIG. 1 a boiler apparatus 10 constructed in accordance with a preferred embodiment of the present invention. The apparatus 10 has a boiler housing 12 and a stand 14 for supporting the housing 12. In a preferred embodiment of the invention, the legs 15 of the housing 12 rest on the stand 14. The housing 12 may be formed of sheet metal panels or other suitable materials. The stand 14 may be formed of metal legs and struts or other suitable materials. The housing 12 has a front door 16. Hinges 18, 20 are located at the bottom edge 22 of the door 16, such that the door 16 opens to the front and downwardly. The door 16 also supports a suitable burner apparatus 24 with flexible fuel and electrical connections (not shown). The open position of the door 16 is shown in dotted lines in FIG. 2.

Figure 3:
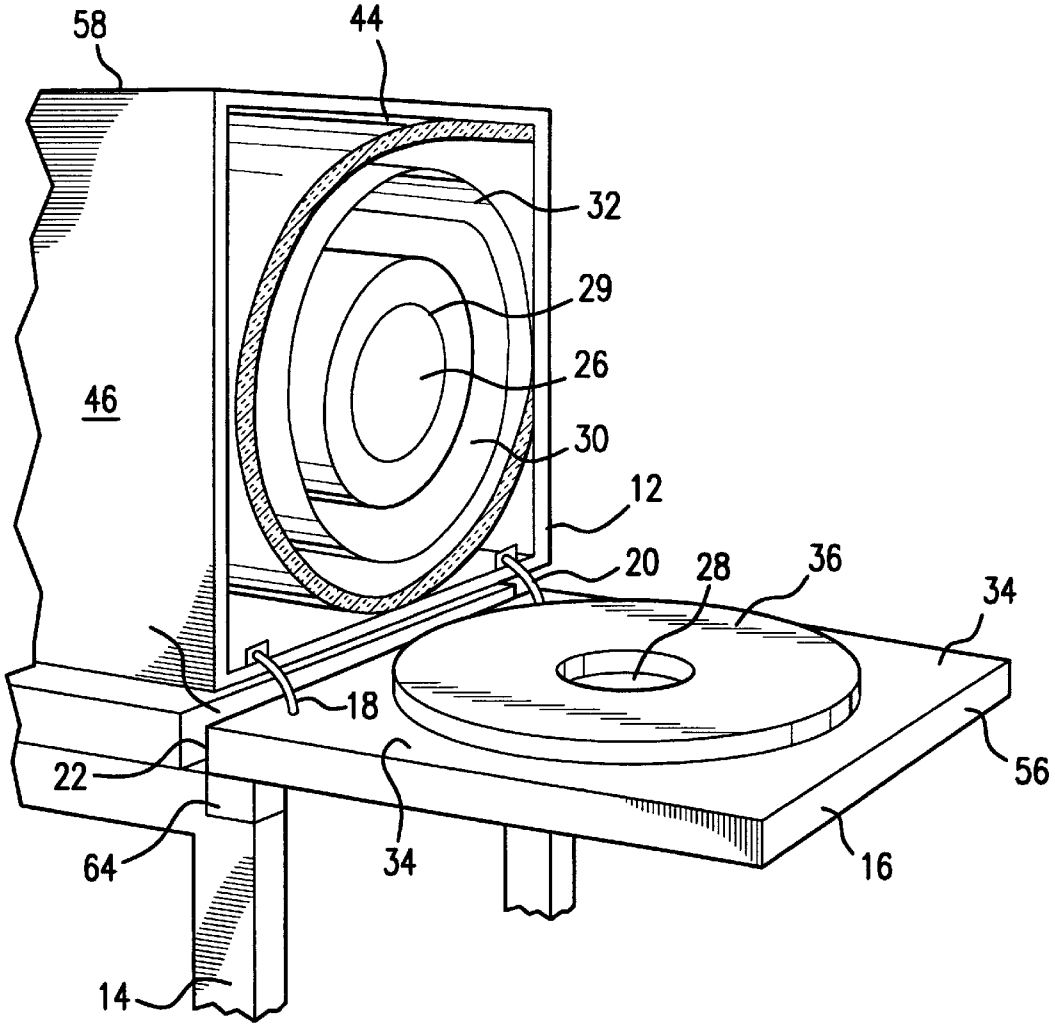
FIG. 3 is a partial perspective view of the boiler apparatus of FIG. 1, showing the front door in an open position

As shown in FIG. 3, an insulated spiral boiler 26 is located within the housing 12. Fuel and combustion air are supplied to the boiler 26 by the burner through a suitable opening 28. The boiler 26 has spiral flow passages 30, 32 for providing heat transfer in the manner described in U.S. Pat. No. 4,261,299, the entire disclosure of which is incorporated herein by reference. The flow passages may include an inner passage 30 and an outer passage 32. The combustion chamber 29 for the boiler 26 may be constructed according to U.S. Pat. No. 4,425,875, the entire disclosure of which is incorporated herein by reference. The present invention should not be limited, however, to the specific instrumentalities described and referred to herein.

An insulated multi-component cover 34, 36 is located within and is supported by the door 16. The cover may include a board 34 and a liner 36. The board 34 may be about two inches thick. In the illustrated embodiment, the board 34 fits within the door 16 and has approximately the same height and width as the door 16. The board 34 may be formed of moderate heat-insulating material. The liner 36 is integrally connected to the board 34. The liner 36 may be formed of high temperature resistant insulation. When the door 16 is closed (solid lines in FIGS. 1 and 2), the cover 34, 36 is in a vertical position and seals off the spiral passages 30, 32. The high temperature liner 36 seals the inner passage 30 and the board 34 seals the outer spiral passage 32. In other words, the cover 34, 36 is shaped to fit and provide a seal against both spiral passages 30, 32. When the door 16 is open, the cover 34, 36 is located within the door 16 in the horizontal position shown in FIG. 3 (dotted lines in FIG. 2). In the horizontal open position, the door 16 may extend no more than about eight inches beyond the floor space required for the apparatus 10 when the door 16 is in the dosed position, although the present invention should not be limited to the specific dimensions shown and referred to herein. In other words, the dimension 104 shown in FIG. 2 (from the burner 24 in the closed position to the top 56 of the door 16 in the open position) may be less than or equal to eight inches.

Figure 2:
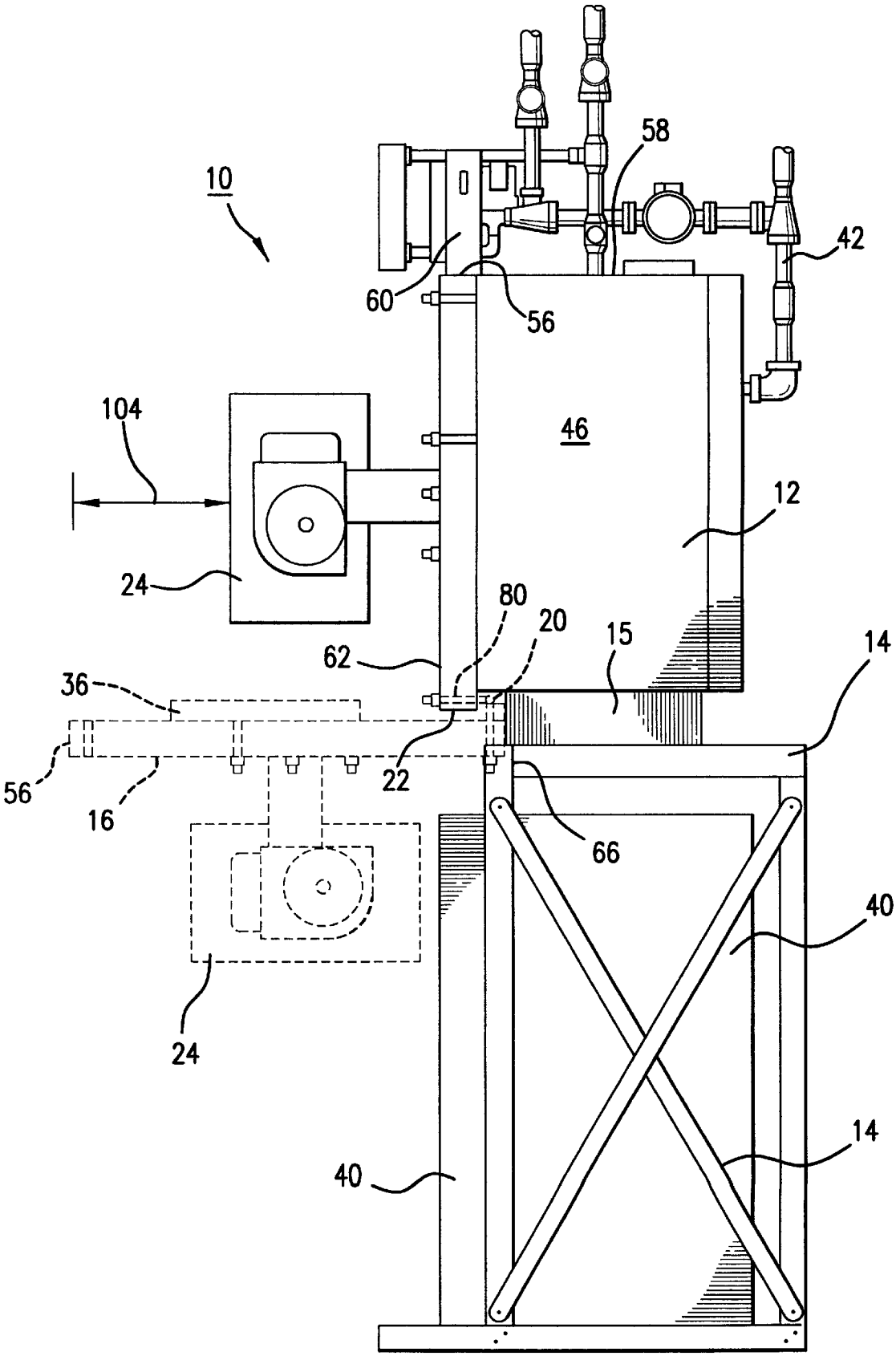
FIG. 2 is a side view of the boiler apparatus of FIG. 1.

An insulated water supply tank 40 may be located within the stand 14 and beneath the boiler housing 12. Since the stand 14 has an open construction, it is relatively easy to install the tank 40 beneath the housing 12. In addition, the tank 40 is not hidden from view. The tank 40 may be used to store domestic hot water heated by the boiler 26. The tank 40 may be connected to the boiler 26 by suitable conduits (not shown). As shown in FIG. 2, room is provided for the burner 24 to be located in front of the tank 40 in the door-open position. Additional conduits and valves 42 may be provided for supplying fuel to the burner 24 and the boiler 26 and for providing water to be heated. The conduits and valves 42 are preferably located toward the rear of the apparatus 10 so that they do not interfere with movement of the door 16 or obstruct access to the boiler passages 30, 32 when the door 16 is open.

The boiler apparatus 10 preferably occupies a minimum amount of floor space so as to fit easily within a closet or other confined location of a residence or commercial building. In a preferred embodiment of the invention, the floor space occupied by the apparatus 10 does not substantially exceed the space occupied by the water supply tank 40. The apparatus 10 may be configured so that all of its components are accommodated substantially within the width of the insulated boiler 26, i.e., such that the total installed width of the apparatus 10 is no more than about one inch (on each side) greater than that of the width of the boiler insulation 44 and side jackets 46. In other words, the width 100 (FIG. 1) of the stand 14 may be no more than about two inches greater than the width 102 of the housing 12. If desired, the slightly greater width of the stand 14 may be used to cause the housing side panels 46 to be slightly spaced away from combustible material (such as a combustible wall, not illustrated).

The spiral boiler 26 by design has relatively cool outer surfaces. Additional insulation 44 (FIG. 3) is wrapped around the outside of the boiler 26 to further contain heat so that the side jacket surfaces 46 remain cool. The wrapped insulation 44 may be formed of glass wool or another suitable material. The reduced temperatures permit the sides 46 of the housing 12 to be located close to combustible materials (e.g., within one inch of combustible materials), which reduces the amount of space occupied by the boiler apparatus 10.

In operation, to service the apparatus 10, bolts 50, 52, 54 (or other suitable connectors) may be released to disconnect the top 56 of the door 16 from the housing 12. The door 16 may then be rotated downwardly about the hinges 18, 20 (by moving the top portion 56 away from the housing top panel 58). A switch 60 may be provided on the top panel 58 such that opening the door 16 automatically disables operation of the boiler 26 or burner 24 mounted on the door 16. A front lower portion 62 of the door 16 engages a top portion of the stand 14, such that the door 16 rests in the illustrated horizontal position. The door 16 does not rotate downwardly beyond the illustrated horizontal position. In the open position, the service technician can inspect and service the boiler passages 30, 32 and the combustion chamber 29.

During servicing, the door 16 may be located between the technician and the opened boiler 26. The spiral passages 30, 32 stay in the housing 12 and do not move. In its horizontal position, the door 16 may be used to support tools, light sources or other equipment. No additional space on the side of the boiler apparatus 10 is needed to provide access to the boiler 26. When the servicing is completed, the door 16 is returned to its upright (FIG. 1) vertical position. The bolts 50–54 are then secured again to the housing 12, and the snitch 60 automatically enables operation of the boiler/burner 24, 26. The switch 60 may be activated by the top 56 of the front cover 16.

The hinges 18, 20 may have an adjustment means for tightening the lower portion of the cover 16, 22, 34 to create an effective seal for the boiler 26. The adjustment means may be, for example, threaded rods 80 for adjusting the positions of the hinges 18, 20 relative to the housing 12.

In a preferred embodiment of the invention, the door 16, the hinges 18, 20, and the stand 14 may have sufficient rigidity such that no additional support for the door 16 is required in the open position (FIG. 3). In a preferred embodiment of the invention, the bottom 62 of the door 16 rests on rubber bumpers 64, 66 on the upper front face of the stand 14.

If desired, the boiler liner 36 may be formed of a soft, compressible, high temperature insulation material. The insulation material may be integrally built into the door 16. The insulation material seals off the interior 30 of the boiler 26 from the interior of the housing 12 when the door 16 is closed. The compressible nature of the insulation material accommodates any misalignment of the door 16 with respect to the boiler 26 when the door 16 is in the closed position.

While preferred embodiments of the invention have been described and illustrated, it should be apparent that many modifications can be made to the preferred embodiments without departing from the spirit or scope of the present invention Accordingly, the invention is not limited by the foregoing description or drawings, but is only limited by the scope of the appended claims.

What is claimed as new and desired to be protected by Letters Patent of the United States is:

1. A heating apparatus, comprising:

a heater for heating water, said heater having a front cover and heat transfer surfaces; and a housing for containing said heater, said housing having a door for providing access to said heat transfer surfaces, said front cover of said heater being connected to said door, and at least one hinge at the bottom of said door for supporting said door in an open position; and wherein said hinge is arranged to support said door in a closed position.

2. A heating apparatus, comprising:

a heater for heating water, said heater having a front cover and heat transfer surfaces; and a housing for containing said heater, said housing having a door for providing access to said heat transfer surfaces, said front cover of said heater being connected to said door, and at least one hinge at the bottom of said door for supporting said door in an open portion; and wherein said hinge is arranged to support said door in a closed position; and wherein said heating apparatus further comprises an adjusting means associated with said hinge for tightening said door.

3. A heating apparatus, comprising:

a heater for heating water, said heater having a front cover and heat transfer surfaces; and a housing for containing said heater, said housing having a door for providing access to said heat transfer surfaces, said front cover of said heater being connected to said door, and at least one hinge at the bottom of said door for supporting said door in an open position; and wherein said heater has spiral flue passages, and wherein said flue passages have edges that are covered and scaled by said front cover.

4. A heating apparatus, comprising:

a heater for heating water, said heater having a front cover and heat transfer surfaces; and a housing for containing said heater, said housing having a door for providing access to said heat transfer surfaces, said front cover of said heater being connected to said door, and at least one hinge at the bottom of said door for supporting said door in an open position; and wherein said heater has spiral passages, and wherein said passages are covered by said front cover; and wherein said front cover includes compressible insulation material for sealing said passages.

5. A heating apparatus, comprising:

a heater for heating water, said heater having a front cover and heat transfer surfaces;

a housing for containing said heater, said housing having a door for providing access to said heat transfer surfaces, said front cover of said heater being connected to said door, and at least one hinge at the bottom of said door for supporting said door in an open position; and a stand for supporting said housing with respect to a water tank, and for permitting removal of said tank without removing said housing from said stand.

6. The apparatus of claim 5, wherein said tank is arranged to receive hot water from said heater, said tank being located underneath said housing.

7. The apparatus of claim 6, wherein said water supply tank is located within said stand.

8. A heating apparatus, comprising:

a heater for heating water, said heater having a front cover and heat transfer surfaces; and a housing for containing said heater, said housing having a door for providing access to said heat transfer surfaces, said front cover of said heater being connected to said door, and at least one hinge at the bottom of said door for supporting said door in an open position; and wherein said heating apparatus further comprises a base for supporting said housing, and wherein a tank is not located underneath said heater.

9. The apparatus of claim 8, wherein said apparatus is arranged to support said door in a horizontal position.

10. A heating apparatus, comprising:

a heater for heating water, said heater having a front cover and heat transfer surfaces;

a housing for containing said heater, said housing having a door for providing access to said heat transfer surfaces, said front cover of said heater being connected to said door, and at least one hinge at the bottom of said door for supporting said door in an open position; and a stand for supporting said housing; and wherein said stand is arranged to support said door in said open position.

11. The apparatus of claim 10, wherein said stand includes rubber bumpers for engaging said door in said open position.

12. A heating apparatus, comprising:

a heater for heating water, said heater having a front cover and heat transfer surfaces;

a housing for containing said heater, said housing having a door for providing access to said heat transfer surfaces, said front cover of said heater being connected to said door, and at least one hinge at the bottom of said door for supporting said door in an open position; and a switch for disabling said boiler and/or said burner in response to opening of said door.

13. A method of operating a boiler apparatus, said method comprising the steps of:

rotating a door downwardly about a hinge to provide access to all heat exchange surfaces of a boiler;

supporting said door in a substantially horizontal position;

inspecting said surfaces while said door is in said substantially horizontal position; and subsequently, rotating said door upwardly about said hinge to seal an insulated cover onto said boiler.

14. A method of operating a boiler apparatus, said method comprising the steps of:

rotating a door downwardly about a hinge to provide access to all heat exchange surfaces of a boiler that has spiral passages;

supporting said door in a substantially horizontal position;

inspecting said surfaces while said door is in said substantially horizontal position; and subsequently, rotating said door upwardly about said hinge to seal an insulated cover onto said boiler, and wherein said passages are covered by said insulated cover.

15. The method of claim 14, wherein said cover includes compressible insulation material.

16. The method of claim 13, further comprising the steps of locating said boiler in a housing, and supporting said housing on a stand.

17. The method of claim 16, further comprising the step of flowing water from said boiler to a tank located underneath said housing.

18. The method of claim 17, further comprising the step of locating said tank within said stand.

19. The method of claim 16, further comprising the step of using said stand to support said door in a substantially horizontal open position.

20. The method of claim 13, further comprising the step of automatically disabling said boiler in response to opening of said door.

* * * * *